United States Patent [19]

Hergeth et al.

[11] Patent Number: 4,514,881

[45] Date of Patent: May 7, 1985

[54] METHOD AND APPARATUS FOR REDUCING FIBER BALES

[75] Inventors: Hubert Hergeth; Helmut Hergeth, both of Dülmen, Fed. Rep. of Germany

[73] Assignee: Hergeth Hollingsworth, GmbH, Fed. Rep. of Germany

[21] Appl. No.: 472,137

[22] Filed: Mar. 4, 1983

[30] Foreign Application Priority Data

Mar. 9, 1982 [DE] Fed. Rep. of Germany ..... 3208346

[51] Int. Cl.[3] ..... D01G 7/06

[52] U.S. Cl. ..... 19/80 R; 19/81

[58] Field of Search ..... 19/80 R, 81

[56] References Cited

U.S. PATENT DOCUMENTS 3,443,285 5/1969 Goldammer et al. ..... 19/81

3,797,072 3/1974 Goldammer ..... 19/81

*Primary Examiner*—Louis K. Rimrodt

*Attorney, Agent, or Firm*—Diller, Ramik & Wight

[57] ABSTRACT

Process and apparatus for reducing the material of rows of fiber bales by means of a milling device reciprocating between two rows of bales. The milling device can be rotated 180° to transfer the milling device between the rows of bales whereby fibers can be removed selectively from two rows of bales.

21 Claims, 4 Drawing Figures

METHOD AND APPARATUS FOR REDUCING FIBER BALES

Figure 1:
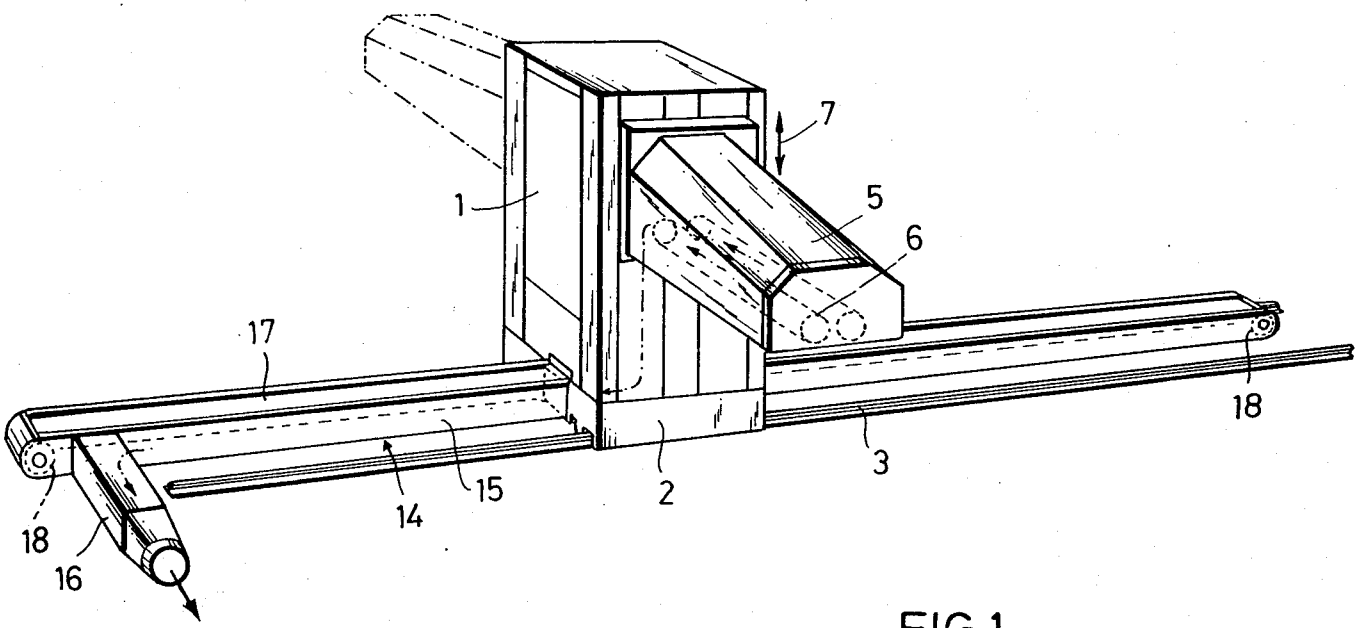

The invention relates to a process and an apparatus for reducing the material of rows of bales consisting of spinning material, e.g. of cotton, synthetic fibers etc., the fiber material being removed from the top of the bales for producing a blend by means of a milling device reciprocating between two rows of bales.

In bale opening devices of the above mentioned type, the milling head is guided at a tower-shaped construction. It is adjustable in height by setting a certain advance, the milling head being located in a cantilever extending transversely relative to the travel direction of the tower. The tower including the cantilever housing the milling head is pivoted and can be swivelled to and fro through 180° at one end of the path of motion to permit to process the rows of bales provided at both sides of the path of travel of the tower. In the known bale opening devices of this type, the swiveling of the tower and its stop at the swivel end points can be only performed manually. This is due to the operation of the bale opening device designed so as to ensure that first one row of bales will be milled off completely, on one side, while a new row of bales is set up on the other side of the path of travel of the tower. Only if the row of bales on one side of the tower is completely worked down, the tower is swivelled manually through 180° to permit to reduce the newly established bale row, while another row is set up again on the first side of the tower.

Swivelling manually the cantilever housing the milling device, from one path of travel of the tower to the other side is complicated and rather time-consuming, because it is also necessary to manually disengage the locking device and to lock again the cantilever in the changed position. In addition, this method is also influencing the blending ratio in the mixer container receiving the removed material. On the one hand, only a restricted number of bales is blended in the mixer, because the removed flocks can be blended only from the number of bales set up in a row. On the other hand, the change from one row of bales reduced completely to the new bale row set up for being reduced at the other side of the tower is very abrupt as to the blending ratio. The compressed density of the bales is different from top to the bottom. In other words, the last layer of cotton or the like of the row of bales on the one side has a different opening factor and is of a different climatic condition than the first layer of a new row of bales at the other side of the tower. This is unfavorable from the technological viewpoint. It being impossible to compensate by means of the subsequent mixer such an abrupt transition and change of the carried-off fibers or flocks, such an abrupt change bears on the continuously operating opening and scutching machines and directly on the carders to result in considerable fluctuations of the card sliver quality. As a matter of fact, with the known performance including the manual swivelling of the milling device, only the bales of the one row are completely represented in the mixture. Thereafter, there is practically always a new beginning in the production of the mixing quality.

It is the object of the invention in connection with a reducing device of the above mentioned type, to substantially improve the mixing quality of the removed flocks in a continuous operation and to permit an increase in output.

The invention is characterized by the fact that the swivelling of the milling device from one row of bales to the other row of bales during the processing is performed by means of an automatic control.

By using an automatic control for the swiveling at the reciprocating frame, it is possible for the milling device, upon its travel along one row of bales on the one side, to be swivelled to the other row of bales on the other side. As a result, the number of bales processed to the mixture is doubled and the rows of bales established at both sides of the frame are uniformly reduced. Flocks of all bales are present at the removing device and in the mixer. The resultant mixtures are of a much better quality and the space requirement is not higher than ever before.

According to another feature of the invention, the changing of the milling device from one row of bales to the other row of bales may be performed optionally after a predetermined number of travels along the one and/or the other side or along both sides. By this means, it is at the discretion of the user to concentrate the processing on one row of bales or the other if it is intended not to begin with or to terminate processing of both rows of bales at the same time, For inst. processing can be concentrated on the one row of bales, while the material of the other side is more or less included in the mixture. Subject to the type of quality of the bales, predetermined blends of quite a different kind can be made up this way. Moreover, the reduction of the material can be so controlled that also with an intermittent operation concerning both rows of bales, a new row can be established by maintaining a predetermined mixing ratio. If, for inst. processing of the one row has been terminated, the other row will be reduced continuously, while a new row is beig set up on the first side. By means of a corresponding number of travels, sufficient material will be then removed from said new row of bales so as to compensate the unequal state of reduction at both rows of bales.

Thereafter, processing may be concentrated on one row of bales, it being possible at any time to admix flocks of the other row of bales.

Many variations are feasible so that subject to the condition of the bales of a row, quite particular mixing ratios can be obtained.

According to the invention, it is also possible to perform upon each travel along both rows of bales an idle return travel of the milling device over both rows at the same time, the idle return travel being performed at increased speed. Thus, a constant mixing ratio can be maintained during the processing of both rows of bales.

However, the control can be so designed that after each processing travel over both rows of bales, the respective return travel again entails a processing of said rows of bales. The resultant mixing result is mirror-inverted, indeed. In many cases, such a reduction method might be desirable.

According to the invention, the swivelling of the milling device through 180° is performed at both ends of the rows of bales to achieve a continuous cycle. This is only possible if the electric lead to the drive units in the frame is of a non-sparking design.

From the apparatus viewpoint, the frame that can be reciprocated by means of a carriage along a rail guidance and which includes a cantilever extending transversely to the travel direction and containing a milling device, e.g. a milling roll, comprises a special drive assembly to cause the rotation or swivelling of the frame through 180° and back. There is assigned to the rotary driving means a programmable control means. The drive means may include a toothed rotating track meshing with a drivable pinion. The drive source of the pinion should be an electric braking geared engine. In addition, also the locking means to retain the frame in the final swivel positions can be controlled automatically. For inst. use can be made of magnetically actuated bolts or the like as locking means.

The invention will be now explained with reference to the embodiments illustrated in the drawings.

Figure 2:
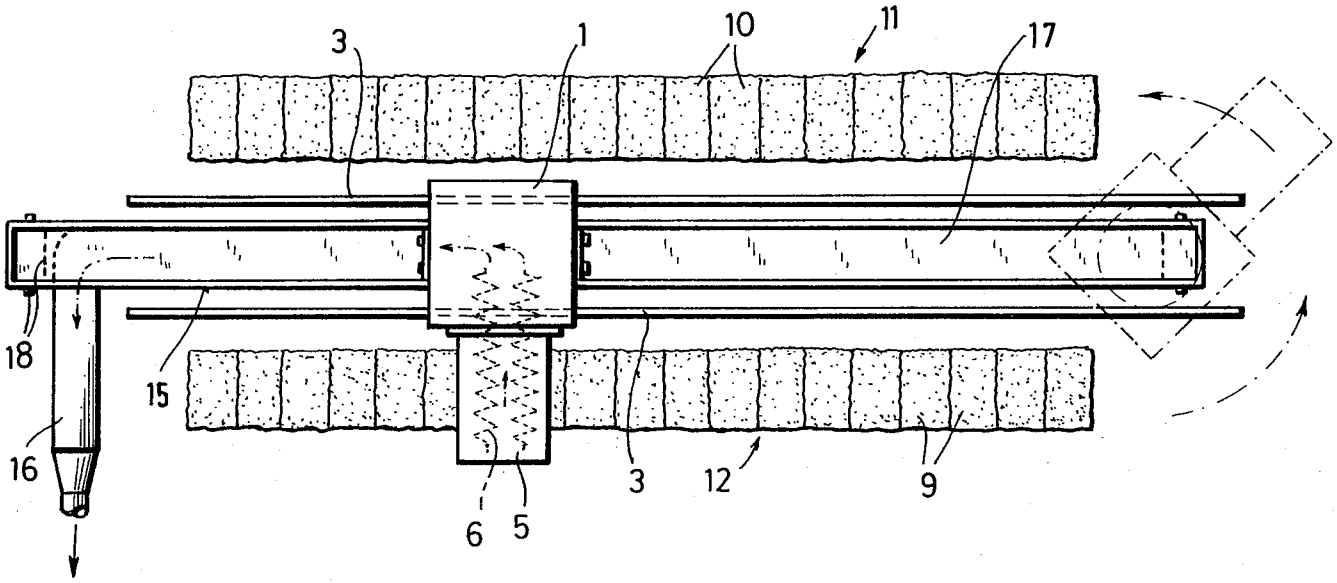
Figure 4:
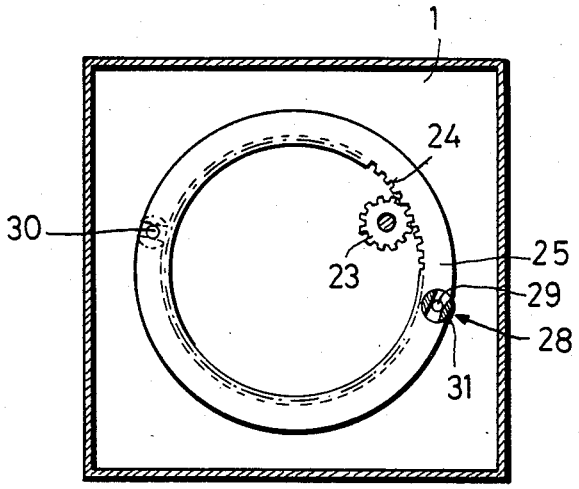
Figure 3:
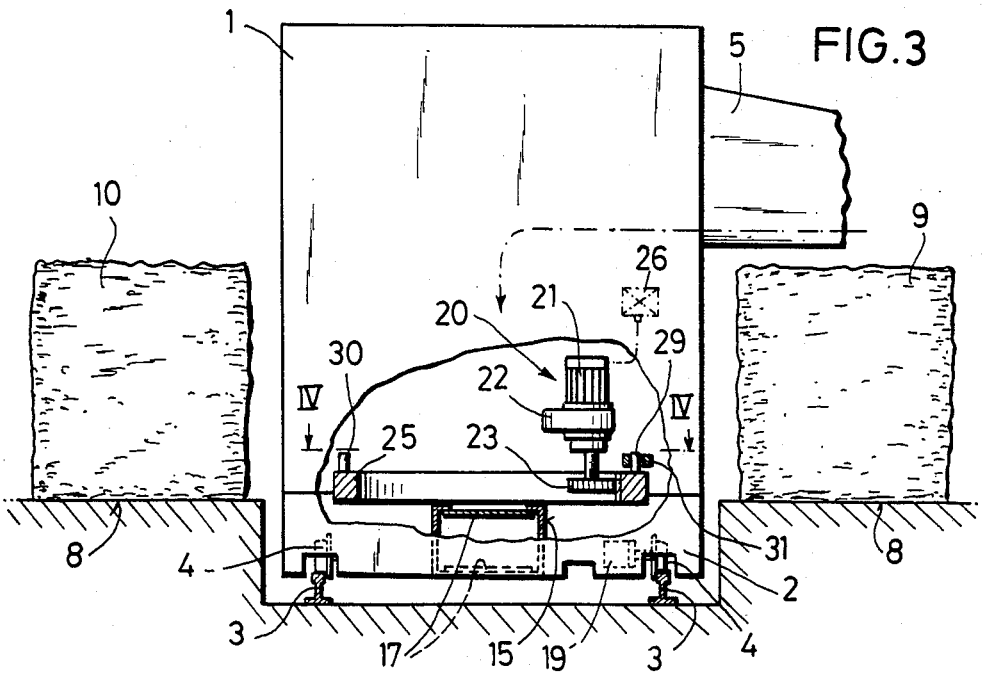

FIG. 1 is a perspective and schematic view from the front end of a device to remove flocks from rows of bales consisting of spinning material, FIG. 2 is a schematic plan view of the reducing means of FIG. 1, FIG. 3 is a schematic view, partly a sectional view, of the frame of the reducing means for the automatic swiveling movement through 180°, FIG. 4 is a detail plan view, according to the line IV—IV of FIG. 3.

The reducing device contains a portable frame 1 which can be reciprocated on a carriage on rails 3 on which the wheels 4 of the carriage 2 are conducted. The one side of the frame 1 is provided with a cantilever 5 housing a milling device 6, preferably milling rolls. The cantilever 5 with the milling rolls 6 can be moved in height according to the arrow 7, by means of an adjustable advance. At both sides of the movable frame 1, bales 9 and 10 consisting of spinning material can be set up on the ground 8 in rows 11 and 12. Below the frame 1 with the carriage 2, there is a device 14 to receive and carry off the flocks removed from the rows of bales. Said device 14 comprises a box 15 closed at its ends and into which the flocks can drop within the frame 1, the box being connected by means of the outlet 16 to a pneumatically operating conveyer line.

The upper side of the box 15 is tightly closed by a ribbon 17 whose ends are firmly connected to each side of the frame. The sealing ribbon 17 is conducted about guide rolls 18 at the end of the box 15. Thus, the frame can be reciprocated while the box is closed, the flocks within the frame getting into the box by absorption. In the carriage 2, a motor 19 is provided to drive traveling wheels 4, it being possible to ensure the electric lead by means of following cables.

As evident from FIGS. 3 and 4, the frame 1 together with the cantilever 5 is equipped with a driving unit 20 for its rotation through 180° and back. A motor 21 with a gear 22 is driving a pinion 23 meshing with the internal teeth 24 of an annular collar 25 inherently connected to the carriage 2. A programmable control means 26 for the motor 21 is housed in the frame 1.

In addition, there are provided locking means 28 to retain the frame in the respective final positions of a swivel movement through 180°. In the illustrated embodiment, the locking means comprise pins 29 and 30 disposed at the stationary crown. In the rotatable frame 1, a fork-shaped claw 31 is pivoted. In its locking position, the legs of the claw fork extend transversely relative to the travel direction such as illustrated by the dash-and-dot line at the pin 31. In case of pin 29, the claw 31 is also in the open position. It is also possible to realise locking by means of magnetic forces, e.g. by a magnetic field or the like, rather than with a mechanically operating locking means with positive locking.

With the automatically driven swivel movement of the frame with the milling device from one row of bales to the other at any optional moment during the processing, a smooth change from one row of bales to the other is readily performable, it being preferred to concentrate reducing to the one side, the processing on the other side of the frame being included with a corresponding dosage. By this means, one side can be completely reduced, while time is saved for setting up the new row of bales, and no abrupt change with regard to the yielded flocks is taking place with the transition from one bale row to the other. The folling example will explain more clearly the situation:

The bale height at both sides should be 1.600 mm which are milled down by 300 milling cycles per side. The advance per milling cycle is 5.33 mm in height. The control is suitably adjusted as follows:

First off, the following cycle would take place 20 times:

the bales at one side of the frame are milled 5 times, subsequently, the bales at the other side of the frame are milled once. Upon 20 milling cycles of this kind, the material height at the one side would be about 1,067 mm, while the height of bales at the other side would be about 1.490 mm. The following 20 milling cycles will take place in the order indicated now: The first row of bales at the first frame side will be processed 4 times, the other side will be processed once. As a result, the height of the first side would amount to 641 mm, while the row of bales at the other side would be 1,387 mm high. Thereafter, 20 milling cycles are performed again, in that 3 travels for milling are made over the bale row of the first side, and 1 travel over the row of bales on the other side. The remaining height of the first row of bales would be only about 108 mm while the row of bales of the other side would be 1.175 mm high. During the next 20 milling cycles, a travel will take place over both row of bales. As a result, the row of bales of the first side is completely reduced, while the row of bales of the other side would still display a remaining height of 1.067 mm. Milling is still effected only at the row of bales of the other side by applying 20 cycles which would take about 40 minutes. During this time, a new row of bales is set up at the first side. Processing is then concentrated on the row of bales of the other side, e.g. by 5 milling operations during the next 20 milling cycles at the row of bales of the other side, while one travel only is made over the row of bales of the first side. Thus, the bales of the first side are now fed slowly again to the mixture under preparation. The next milling operations would include 20 travels having the following cycle:

4 times at the row of bales of the other side, and once at the row of bales of the first side. If the row of bales of the other side is completely milled off, the processing would be concentrated again on the row of bales of the first side, while a new row of bales is being set up on the other side. By selecting such an alternating travel performance over the row of bales, an abrupt transition of the yielded flocks from the rows of bales of the one side to the other side can be avoided. At the same time, the rows of bales reduced completely can be replaced by new rows of bales during the processing of the other row of bales.

What is claimed is:

1. A process for reducing the material of rows of bales of spinning material such as cotton, synthetic fiber material and the like comprising the steps of positioning two rows of bales in side-by-side generally parallel relationship with a space therebetween, spanning one row of the bales with a milling device carried by a frame positioned generally within the space, operating the milling device to remove flocks from the one row of bales while simultaneously moving the frame along the rows with the space, rotating the frame and thus the milling device through generally 180° to transfer the milling device to a position spanning the other of the row of bales, operating the milling device to remove flocks from the other row of bales while simultaneously moving the frame along the rows within the space, and delivering the removed flocks from the one and other row of bales to the space through the frame.

2. The reducing process as define in claim 1 wherein the frame rotating step is not performed until the one row of bales has been substantially entirely depleted by the milling device whereby the depleted row of bales can be replenished by a new row of bales during the operation of the milling device along the other row of bales.

3. The reducing process as defined in claim 1 wherein the frame rotating step is performed after a single pass in but one direction of travel of the frame along the rows within the space.

4. The reducing process as defined in claim 1 wherein the frame rotating step is performed after at least one complete reciprocal cycle of the frame along the rows within the space.

5. The reducing process as defined in claim 1 wherein the frame rotating step is performed after each single pass of the frame along each row.

6. The reducing process as defined in claim 1 wherein the frame rotating step is performed after a predetermined number of reciprocal passes of travel in opposite directions by the frame along the rows within the space.

7. The reducing process as defined in claim 1 including the step of selectively terminating the operation of the milling device during any pass of the frame in either direction along the rows within the space.

8. The reducing process as defined in claim 1 wherein the frame rotating step is not performed until the one row of bales has been substantially entirely depleted by the milling device during reciprocal movement of the frame whereby the depleted row of bales can be replenished by a new row of bales during the operation of the milling device along the other row.

9. An apparatus for reducing the material of rows of bales of spinning material such as cotton, synthetic fiber material and the like comprising means for defining a path of travel between two rows of bales disposed in generally side-by-side parallel spaced relationship, means for moving a frame along said path in first and second opposite directions in a generally reciprocal fashion, milling means carried cantilevered by said frame for removing flocks from one row of bales during the movement of said frame along said path and for removing flocks from the other row of bales during the movement of said frame along said path, means for rotating said frame and the milling means carried thereby through generally 180° to transfer the milling means between the rows of bales whereby flocks can be removed selectively from the two rows of bales, and means for delivering the removed flocks to the space during the removal thereof and while the milling means is above both the one and other row of bales.

10. The apparatus as defined in claim 9 including control means for operating said rotating means only after one row of bales has been substantially entirely depleted by said milling device during reciprocal movement of said frame in said first and second directions whereby the depleted row of bales can be replenished by a new row of bales after the operation of said rotating means and the operation of said milling means along the other row of bales.

11. The apparatus as defined in claim 9 including control means for operating said rotating means after a single pass of said frame in but one direction of travel along the rows of bales.

12. The apparatus as defined in claim 9 including control means for operating said rotating means after at least one complete reciprocal cycle of the frame occurs by movement thereof in said first and second directions.

13. The apparatus as defined in claim 9 including control means for operating said rotating means after each single pass of the frame along each row in any one of said first and second directions.

14. The apparatus as defined in claim 9 including control means for operating said rotating means after a predetermined number of reciprocal passes of travel in said first and second directions by said frame.

15. The apparatus as defined in claim 9 including control means for selectively terminating the operation of said milling means during any pass of the frame in either direction along the rows of bales.

16. The apparatus as defined in claim 9 including control means for operating said rotating means only after one row of bales has been substantially entirely depleted by the milling means during reciprocal movement of said frame.

17. The apparatus as defined in claim 9 including a carriage, means mounting said frame for rotation relative to said carriage, and said frame rotating means includes driving means for drivingly rotating said frame through said generally 180°.

18. The apparatus as defined in claim 17 wherein said driving means includes a toothed track driven by meshing engagement with a toothed pinion.

19. The apparatus as defined in claim 17 wherein said driving means includes a toothed track driven by meshing engagement with a toothed pinion, and means for locking said frame at positions thereof angularly offset 180° from each other.

20. The apparatus as defined in claim 17 wherein said driving means includes a toothed track driven by meshing engagement with a toothed pinion, and magnetic means for magnetically locking said frame at positions thereof angularly offset 180° from each other.

21. The apparatus as defined in claim 17 wherein said driving means includes a toothed track driven by meshing engagement with a toothed pinion, and mechanical means for mechanically locking said frame at positions thereof angularly offset 180° from each other.

* * * * *